US007212163B2

(12) United States Patent
Huang et al.

(10) Patent No.: US 7,212,163 B2
(45) Date of Patent: May 1, 2007

(54) CIRCULAR POLARIZED ARRAY ANTENNA

(75) Inventors: Kao-Cheng Huang, Stuttgart (DE); Stefan Koch, Oppenweiler (DE); Masahiro Uno, Fellbach (DE)

(73) Assignee: Sony Deutschland GmbH, Cologne (DE)

( * ) Notice: Subject to any disclaimer, the term of this patent is extended or adjusted under 35 U.S.C. 154(b) by 0 days.

(21) Appl. No.: 11/053,997

(22) Filed: Feb. 9, 2005

(65) Prior Publication Data

US 2005/0200531 A1 Sep. 15, 2005

(30) Foreign Application Priority Data

Feb. 11, 2004 (EP) ..... 04003076
Sep. 29, 2004 (EP) ..... 04023212

(51) Int. Cl.
*H01Q 1/38* (2006.01)

(52) U.S. Cl. ..... 343/700 MS; 343/893

(58) Field of Classification Search ..... 373/700 MS, 373/786, 846, 848, 893
See application file for complete search history.

(56) References Cited

U.S. PATENT DOCUMENTS 4,743,915 A * 5/1988 Rammos et al. ..... 343/776
4,761,654 A 8/1988 Zaghloul ..... 343/700 MS
4,866,451 A 9/1989 Chen ..... 343/700 MS
5,087,920 A * 2/1992 Tsurumaru et al. .. 343/700 MS
5,181,042 A * 1/1993 Kaise et al. ..... 343/700 MS
5,287,116 A * 2/1994 Iwasaki et al. ..... 343/700 MS
5,382,959 A * 1/1995 Pett et al. ..... 343/700 MS
5,661,494 A * 8/1997 Bondyopadhyay ... 343/700 MS
6,061,026 A * 5/2000 Ochi et al. ..... 343/700 MS
6,121,931 A * 9/2000 Levi ..... 343/700 MS
6,239,762 B1 * 5/2001 Lier ..... 343/770
6,320,542 B1 * 11/2001 Yamamoto et al. .. 343/700 MS
6,593,895 B2 * 7/2003 Nesic et al. ..... 343/795
2003/0201941 A1 * 10/2003 Aikawa et al. ..... 343/700 MS
2005/0200531 A1 * 9/2005 Huang et al. ..... 343/700 MS

FOREIGN PATENT DOCUMENTS

EP 0 450 881 10/1991
GB 2 238 665 6/1991

* cited by examiner

*Primary Examiner*—Hoanganh Le
*Assistant Examiner*—Tung Le
(74) *Attorney, Agent, or Firm*—Oblon, Spivak, McClelland, Maier & Neustadt, P.C.

(57) ABSTRACT

A circular polarized array antenna includes: groups of at least one set of patches for radiating and/or receiving a circular polarised electromagnetic wave; and a network of feeding lines, each feeding line being coupled to and extending longitudinally or vertically to one of the sets for transferring signal energy to and/or from the set. Each of the feeding lines coupled to the sets is pointing into a direction different from the pointing direction of the other feeding lines in order to achieve a circular orientation of the network of feeding lines.

70 Claims, 7 Drawing Sheets

CIRCULAR POLARIZED ARRAY ANTENNA

Figure 1:
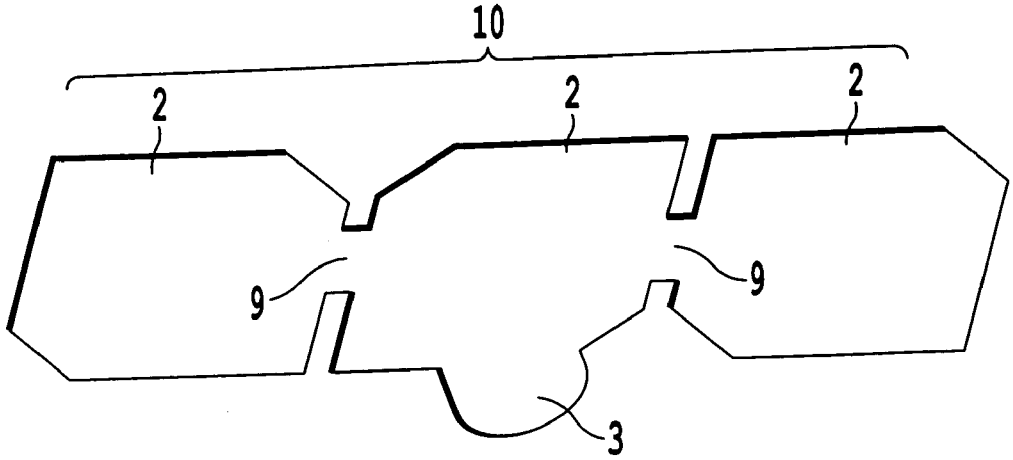

The invention relates to a circular polarised array antenna according to claim 1 and to a method for an array antenna according to claim 21.

In the recent past, the requirements for an antenna have significantly increased. Modern antennas must be more sophisticated to amplify signals of interest while nullifying noise and signals from other areas. Especially at high-speed data rate, it is preferred to have radiation pattern with small side-lobe and high gain for the purpose of reducing mutli-path effect and reducing power consumption.

CA 2 063 914 discloses a multibeam antenna and a beam forming network comprising a multiple beam or phased array antenna, antenna feeds and electronically beam steering networks. Horn antennas together with multiple dielectric resonators are added to form a radiator. The disadvantage of this antenna is its complexity as it requires two feeding lines for each radiator. Further, it does not provide manufacturing easiness for its horn installation.

The document "Aperture Coupled Microstrip Antenna With Quasi-Planner Surface Mounted Horn" by Abdel-Rahman et al, European Microwave Conference 2003, discloses a combination of aperture coupled microstrip antenna and a quasi-planner surface mounted short horn to increase the gain of a patch antenna. The disadvantage is that it does not work for circular polarisation as it can only be used for linear polarisation. It only provides medium gain and its side-lobe suppression is rather low.

Document U.S. Pat. No. 4,090,203 discloses an antenna system consisting of basic subarrays consisting of seven or nine radiating elements arranged respectively in a circle with a central element or in the form of a square. Radiating elements are set in phase but the power applies to each element and the spacing is so selected that due to interference the side-lobes substantially disappear. The disadvantage of this antenna is its complexity as it requires a feeding line for each radiating element. Further, it does not provide manufacturing easiness.

It is therefore an object of the present invention to provide an array antenna for circular polarisation being easy to manufacture and having high gain and a superior performance including low side lobe for circular polarisation.

It is a further object of the present invention to change the beaming direction of the array antenna without having high losses or noise.

This object is achieved by means of the features of the independent claims.

According to the present invention a circular polarised array antenna is proposed comprising groups of at least one set of patches for radiating and/or receiving a circular polarised electromagnetic wave, a network of feeding lines, each feeding line being coupled to and extending longitudinally or vertically to one of the sets for transferring signal energy to and/or from the set whereby each group of feeding lines being coupled to a group of sets is pointing into a direction different from the pointing direction of the other groups of feeding lines in order to achieve a circular orientation of the network of feeding lines and respectively two adjacent groups of feeding lines include the same angle.

Further, according to the present invention a method for an array antenna is proposed comprising the steps of radiating and/or receiving a circular polarised electromagnetic wave by groups of at least one set of patches, providing a network of feeding lines, each feeding line being coupled to and extending longitudinally or vertically to one of the sets for transferring signal energy to and/or from the set, arranging each group of feeding lines being coupled to a group of sets in a way, that each group of feeding lines has a pointing direction different from the pointing direction of the other groups of feeding lines in order to achieve a circular orientation of the network of feeding lines, and arranging respectively two adjacent groups of feeding lines in a way, that they include the same angle.

Further, according to another aspect of the present invention, an array antenna is proposed comprising patches for radiating and/or receiving a circular polarised electromagnetic wave and horn antennas, each horn antenna added to one of the patches in order to keep the same circular polarisation and increase gain, whereby the horn antennas are arranged in groups of at least one horn antenna and each group of horn antennas has a beaming direction different from the beaming direction of the other groups of horn antennas.

Further, according to the present invention, a method for a beam-switching array antenna is proposed comprising the steps of radiating and/or receiving a circular polarised electromagnetic wave by sets of at least one patch and providing horn antennas, each horn antenna added to one of the sets in order to keep the same circular polarisation and increase gain, thereby arranging the horn antennas in groups of at least one horn antenna in a way that each group of horn antennas has a beaming direction different from the beaming direction of the other groups of horn antennas.

By providing patches for radiating and/or receiving a circular polarised electromagnetic wave in combination with a circular oriented feeding network a high performance of circular polarisation can be achieved including high gain and low noise.

Further, by providing horns having different beaming directions, a wide area of the hemisphere can be covered without sacrificing the radiation characteristics of the signal.

In addition, by providing only one feeding line for a set of patches it is possible to reduce the complexity of the feeding network.

Preferably, a set comprises at least one patch.

Advantageously, the angle between the pointing directions of two adjacent groups of feeding lines is equal to 360 degrees divided by the number of groups of feeding lines.

Further, advantageously, the phase between two adjacent groups of feeding lines is equal to 360 degrees divided by the number of groups of feeding lines.

In a preferred embodiment the array antenna consists of at least four sets (10) of patches (2) arranged in an quadratic 2×2 array.

Further, in the preferred embodiment the angle between the pointing directions of two adjacent feeding lines is equal to 90 degrees for improving circular polarisation.

Further, advantageously, the phase between two adjacent feeding lines is equal to 90 degrees.

Advantageously, the set of patches consists of three patches.

Further advantageously, the feeding line is coupled to the central patch of the set of three patches.

Preferably, connection elements are provided for connecting the patches of a set of patches in order to enable transmission of signal energy between the patches.

In a first embodiment the connection element is a microstrip element.

In another embodiment the connection element consists of discrete electric components.

Preferably, a dielectric superstrate is provided on top of the patch.

Further preferably, the dielectric superstrate is a quarter-wavelength superstrate.

Advantageously, at least two sets of patches are integrated into one piece.

Preferably, a horn antenna is added to each set of patches in order to improve gain.

Further preferably, slots are provided respectively between two horns for suppressing surface waves.

In a preferred embodiment at least a part of the horn is hollow.

Figure 2:
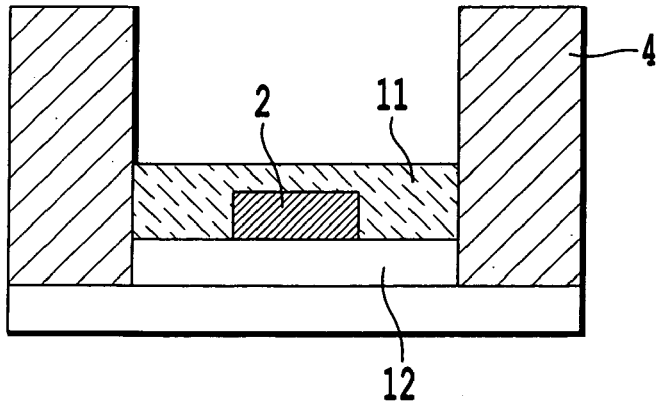
Figure 3:
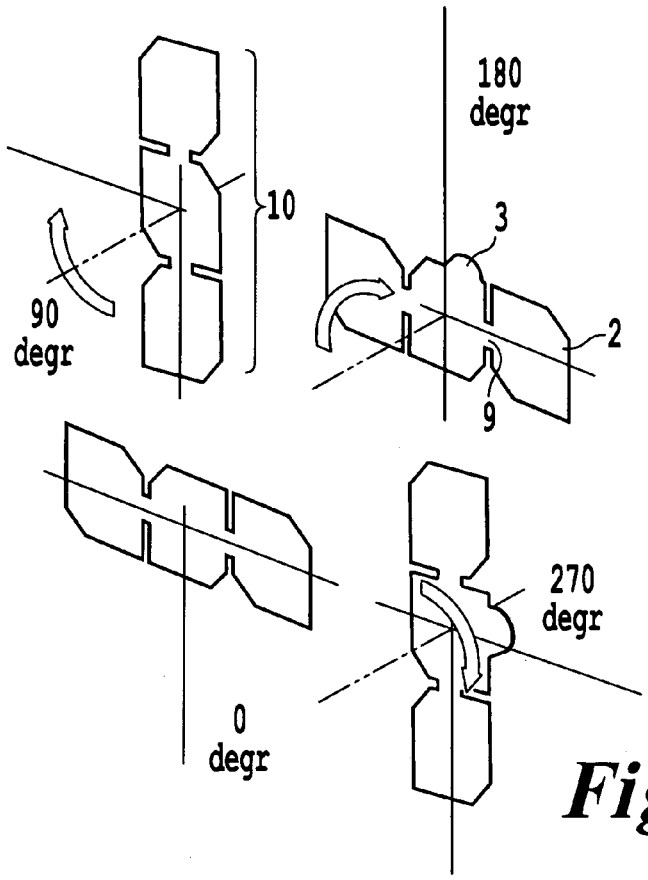
Figure 4:
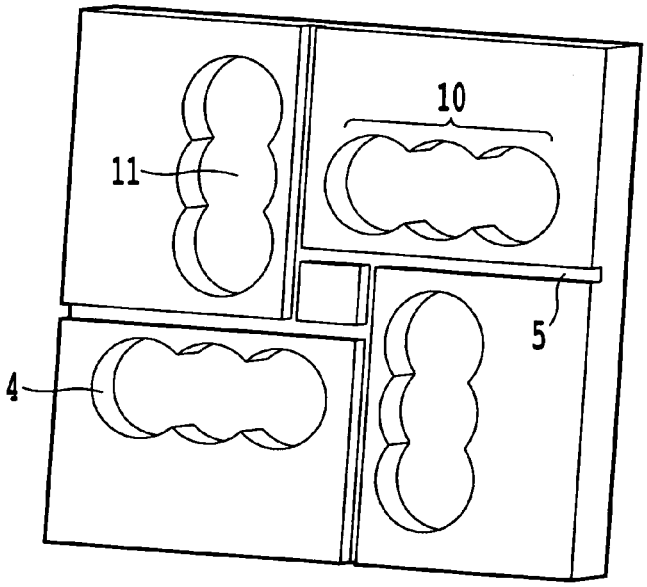
Figure 5A:
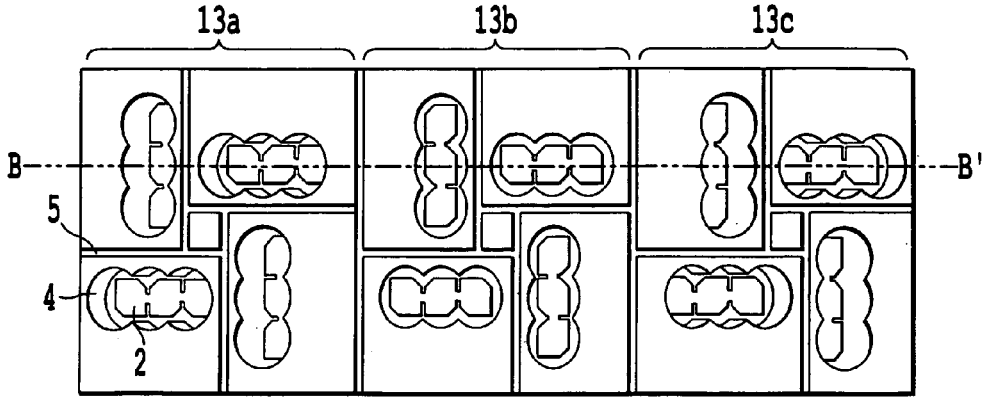
Figure 5B:
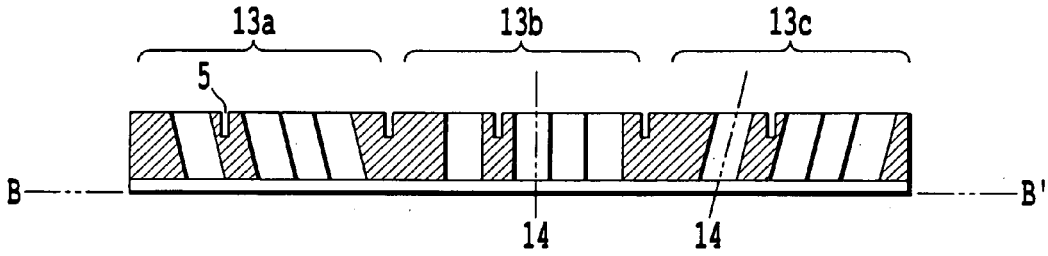
Figure 6:
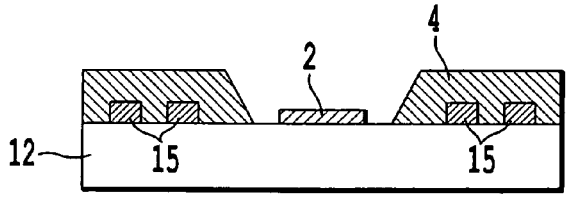
Figure 7:
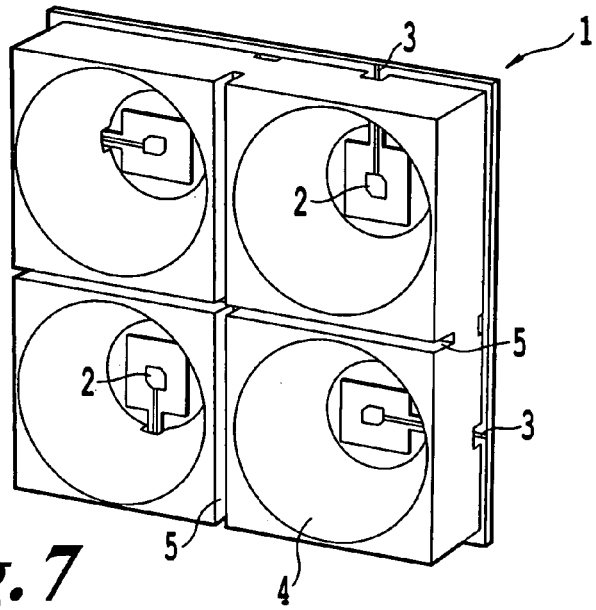
Figure 8:
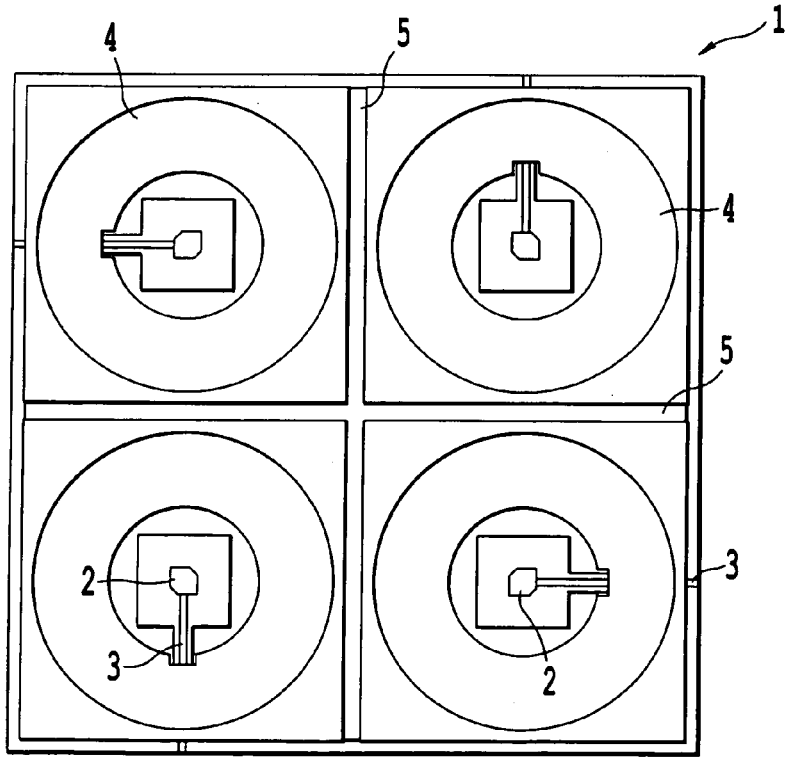
Figure 9A:
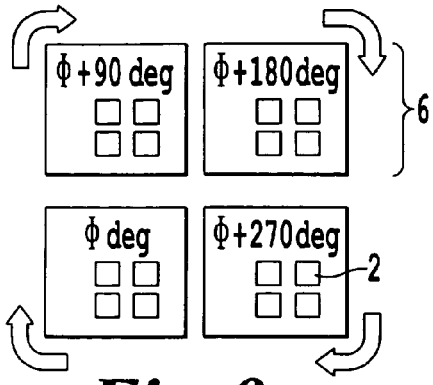
Figure 9B:
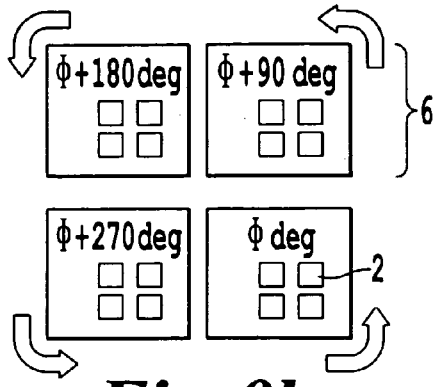
Figure 9C:
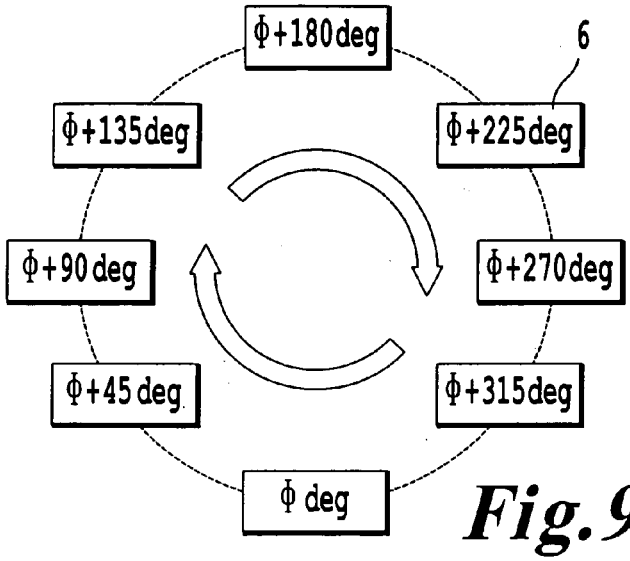
Figure 9D:
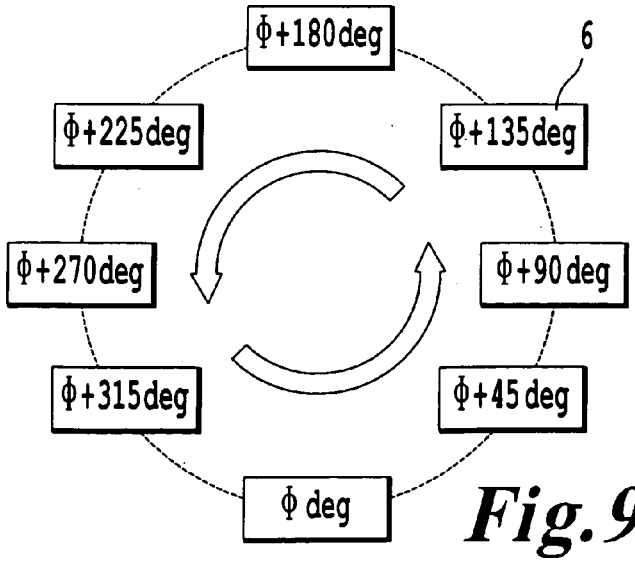
Figure 10:
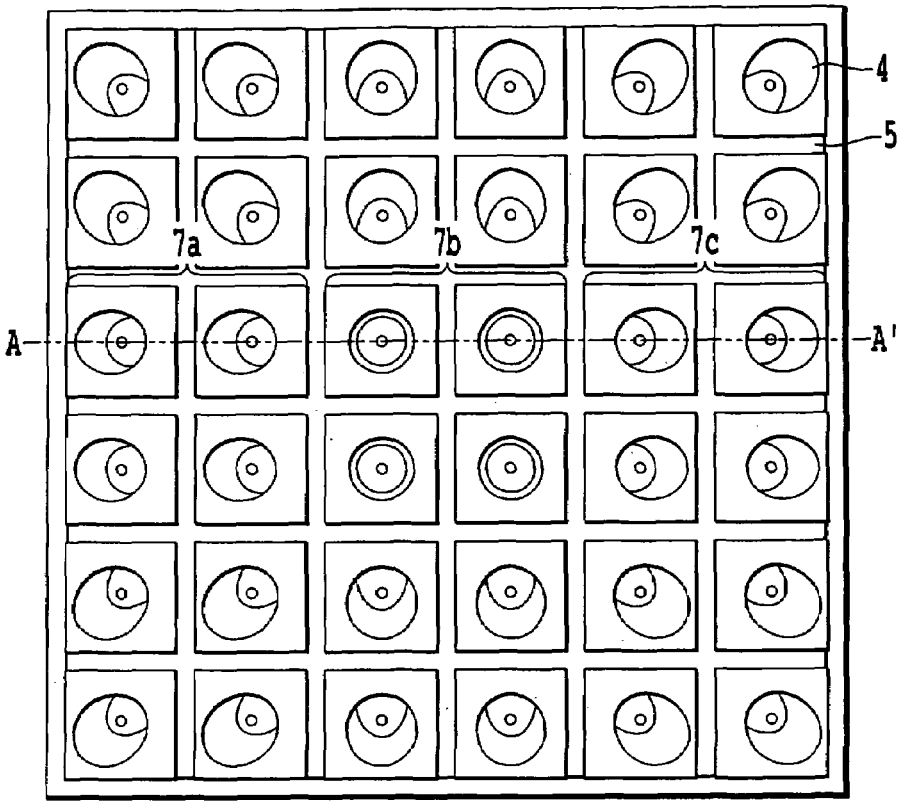
Figure 11:
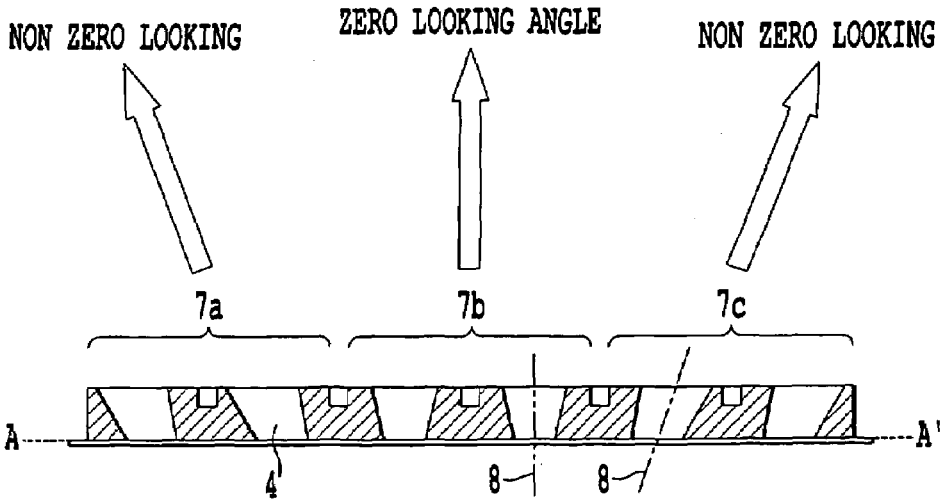
Figure 12:
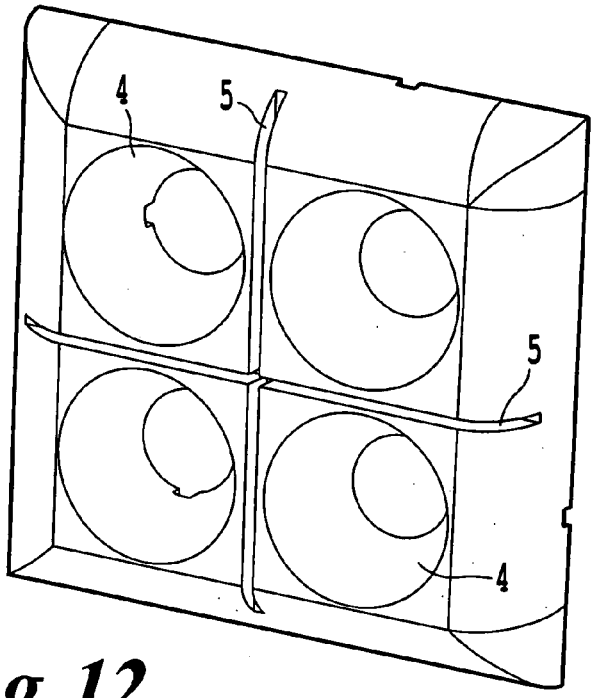
Figure 13:
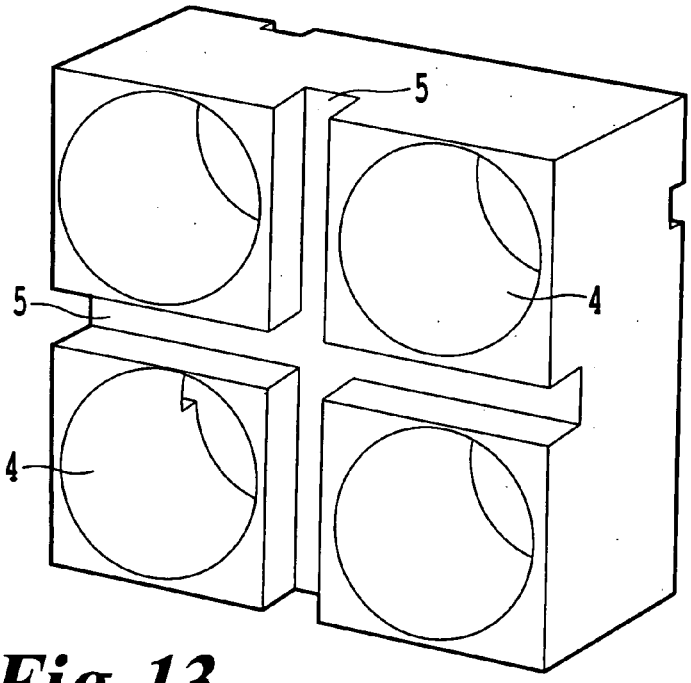

Embodiments of the invention will now be described, by way of example only, with reference to the accompanying drawings in which:

FIG. 1 shows a set of patches of an array antenna according to the present invention, FIG. 2 is a cross-section of the array antenna according to the present invention, FIG. 3 is a plan view of an array antenna showing different orientations of sets of patches, FIG. 4 shows a second embodiment of an array antenna according to the present invention, FIG. 5*a* shows an array antenna having groups of horn antennas with different beam directions, FIG. 5*b* is a cross-section of FIG. 5*a*, FIG. 6 shows an array antenna having a hollow horn part, FIG. 7 shows an array antenna having improved circular polarisation, FIG. 8 is a plan view of an array antenna having improved circular polarisation, FIGS. 9*a* to 9*d* are block diagrams showing the different pointing directions of the groups of feeding lines associated to groups of patches, FIG. 10 shows an array antenna having groups of horn antennas with different beaming directions, FIG. 11 is a cross section of FIG. 10, FIG. 12 is a first embodiment of a horn antenna, and FIG. 13 is a second embodiment of a horn antenna.

FIG. 1 shows an array antenna comprising a set 10 of patches 2 for radiating and/or receiving a circular polarised electromagnetic wave, which can be right hand or left hand circular polarised depending on the configuration of the patch and the feeding line 3. The set 10 has an associated feeding line 3, which is coupled to one patch 2 of the set 10 of patches 2 and is able to transfer signal energy to and/or from the associated patch 2. Feeding can be done not only by feeding lines which are extending longitudinally or vertically. Feeding can also be done e.g. via a hole in the middle of the patch which connects to a different layer in a multilayer substrate. The most important is, that the relative phase angles at the patches are created correctly. Preferably, the set 10 of patches 2 consists of three patches 2, whereby the feeding line 3 is coupled to the central patch 2.

The patches 2 of the set 10 of patches 2 are connected with connection elements 9 in order to enable the transferring of signal energy between the patches, so that the signal energy transferred by a feeding line 3 to the central patch 2 is further transferred to the other patches 2 of the set 10 of patches.

The connection elements 9 hereby can either be microstrip elements or discrete electric components like resistance R, coil L or capacitor C or combinations out of them. The ratio of the power amplitude at the outer patch elements to the power amplitude at the centre patch element is controlled by the connection elements 9 between the central patches and the outer patches. The central patch has a higher amplitude than the outer patches. The side-lobe level is closely related to the abruptness with which the amplitude distribution ends at the edge of an array. The connection between the patches 2 is used to control the amplitudes of each patch. Small amplitudes at both edges of the patch elements produce small side-lobe radiation. When the amplitude tapers to small values at the edge of the patch element, minor lobes can be eliminated. An array antenna according to the present invention having a set 10 of three patches 2 provides a non-uniform power distribution instead of a uniform power distribution. With a uniform distribution the power amplitudes of the three patches 2 of the set 10 of patches would be of the ratio 1:1:1. In contrast hereto a non-uniform power-distribution such as a binomial distribution or a Dolph-Tchebyscheff distribution of 1:A:−1 can be achieved, where A is the amplitude of the central patch and $1<A\leqq 2$.

By providing only one feeding line 3 for a set 10 of patches 2 the side lobe level can be reduced without introducing a complex feeding network. No additional attenuator or amplifier is required.

FIG. 2 shows a cross section of an array antenna according to the present invention. Hereby, the patch 2, which may be a single patch 2 or a set 10 of patches 2, is provided on a substrate 12. In order to increase the gain of the antenna a dielectric superstrate 11 is provided on top of the patch 2. The material of the superstrate 11 has a higher dielectric constant than the substrate 12. By using a quarter-wavelength superstrate with high dielectric constancy on top of a patch 2, electric fields are attracted in broad side direction and so the gain is increased. This superstrate 11 provides a good impedance matching between patch 2 and the air in order to get maximum power radiation.

A circular horn or waveguide antenna 4 can be added to the patch 2 in order to improve the circular polarisation performance and the gain of the whole antenna. In case a superstrate 11 is provided, the size of the superstrate is the same as the aperture of the surrounding horn 4. The shape of the dielectric superstrate can be either a plate or a lens-shape, that is a concave or a convex shape.

FIG. 3 shows an array of four sets 10 of patches 2. In order to improve circular polarisation the sets 10 of patches 2 can be arranged in a way that the longitudinal axis of the set 10 of patches is rotated either clockwise or counter-clockwise.

FIG. 4 shows an array antenna consisting of four sets 10 of patches 2 being arranged in a 2×2 array, whereby the longitudinal axis of each set 10 is rotated by 90°. A horn antenna 4 consisting of one piece is added to the array antenna in order to improve the gain. Hereby horn antennas 4 for every set 10 of patches are integrated in the horn antenna piece. In order to remove unwanted electromagnetic influence from one element to the other when combining the antenna, slots 5 are provided respectively between two horns 4 of sets 10 in order to avoid cross-coupling or surface-waves which would result in an impact on the antenna performance. Further, on each set 10 of patches 2 the dielectric superstrate 11 can be added.

FIG. 5*a* shows an array of several sets 10 of patches 2 and associated horn antennas 4. In general, every radiating/receiving element has a main beaming direction. In order to properly describe such direction, a sphere coordinate system is introduced. Hereby, the z-axis designates the direction vertically extending from the plain of the antenna. Further, the θ- and ϕ-angles denote the elevation and azimuth angle in the sphere coordinate system.

Standard multi-array antennas are designed to have their zero-looking angle, which is the main beam direction into the direction of the z-axis. In order to cover a wider area of the hemisphere the looking angle of the beam is changed to different θ- and ϕ-angles by using phase shifting for changing the beam direction. This yields to the problem that the control of unwanted signals such as side-lope suppressions becomes very difficult for all states of the beam steering.

According to FIG. 5*a* horns having different beam directions are therefore integrated in the antenna array according to the present invention. Hereby, the central axis of the horn is tilt depending on the position of the horn 4. FIG. 5*b* shows a cross section along the line B to B' in FIG. 5*a*. It can be seen that in the example as shown in FIGS. 5*a* and 5*b* at a time the horns 4 of four sets 10 of patches 2 have the same beam direction 13*a*, 13*b* or 13*c*. Hereby, the horns 4 in the middle have a vertical beam direction 13*b* along the z-axis of the sphere coordinate system. The more the horns 4 are away from the horns 4 in the middle, the more the beam direction is tilted, that is the angle between the axis 14 of the lateral horns 4 and the axis 14 of the middle horns 4 is increased. Depending on the desired beaming direction the signal energy transferred to and/or from the horns 4 is switched between the horns 4 having different beaming directions by a switch integrated in the control circuit of the array antenna. This way, a wide coverage of the hemisphere can be achieved without sacrificing the suppression of unwanted noise or side-lope signals.

It is to be noted that a group of horn antennas 4 having the same beaming direction may consist of one or more horn antennas arranged either in a row, rectangular, circular or otherwise, in a two- or three-dimensional array.

Hereby, the area, that is the beam scanning range covered by the whole antenna array is equal to the beam width covered by a single group of horns (4) having the same beaming direction multiplied with the number of beaming directions realised by different groups of horns (4).

FIG. 6 shows an array antenna according to the present invention having hollow horn antennas 4. The patch 2 or set 10 of patches is provided on the substrate 12 and the horns 4 are hollow so that parts of the circuitry, e.g. electric components 15, can be placed under the hollow horn part in order to shrink the circuit size. It is also possible to use the horn part as an electric shield.

In order to improve the circular polarisation of the array antenna, the patches 2 of a set 10 of patches can have different orientation, that is every patch 2 is rotated by e.g. 90° with respect to the adjacent patch 2. In addition, a feeding network improving circular polarisation can be used as will be explained in the following.

FIG. 7 shows an array antenna comprising patches 2 for radiating and/or receiving a circular polarised electromagnetic wave, which can be right hand or left hand circular polarised depending on the configuration of the patch and the feeding line 3. Each patch 2 has an associated feeding line 3, which is extending longitudinally to the patch 2. The feeding line 3 is coupled to the patch 2 and is able to transfer signal energy to and/or from the patch 2. Feeding can be done not only by feeding lines which are extended longitudinally or vertically. Feeding can also be done e.g. via a hole in the middle of the patch which connects to a different layer in a multilayer substrate. The most important is, that the relative phase angels at the patches are created correctly.

As can be seen from FIG. 8 the pointing direction, that is the orientation, of each feeding line 3 is different from the pointing directions of the other feeding lines 3. Thereby, a circular orientated feeding network of feeding lines 3 is achieved, which provides additional advantages to the performance of circular polarisation. In addition, the polarisation direction can be amplified, e.g. a right hand circular polarisation patch together with circular orientated feeding network will result in a radiation more on right hand direction than on left hand. The main beam of undesired polarisation is therefore small, and far away from the desired one.

This assembly can be used on both single layer and multi-layer array antennas.

According to FIGS. 7 and 8 a circular horn or waveguide antenna 4 can be added to each patch 2 in order to keep the circular polarisation performance and to also improve the gain of the whole antenna. Hereby, a horn antenna 4 having a cylindrical or conical shape is placed on every patch 2 of the array antenna. By integrating the proposed multi-horn antenna in one piece, a design cheap in cost is realised and the advantage of easy installation can be achieved.

In order to remove unwanted electromagnetic influence from one element to the other when combining the antenna, slots 5 are provided respectively between two horns 4 in order to avoid cross-coupling or surface-waves which would result in an impact on the antenna performance.

The array antenna according to FIGS. 7 and 8 consists of four patches 2 with feeding lines 3, whereby the pointing directions of two adjacent feeding lines 3 include an angle of 90 degrees. Also the phase between two adjacent feeding lines 3, that means the phase between two signals fed by two adjacent feeding lines 3, include angle of 90 degrees. It is also possible to use a higher number of patches with respective feeding lines 3 having different pointing directions, whereby the angle between the pointing directions of two adjacent feeding lines 3 or the phase between two adjacent feeding lines 3 is equal to 360 degrees divided by the number of feeding lines 3. If e.g. eight patches 2 are provided, then the angle and the phase between two feeding lines 3 will be set to 45 degrees.

According to FIGS. 9*a* to 9*d*, it is also possible to use groups 6 of patches 2, whereby each group of feeding lines 3 being coupled to a group 6 of patches 2 is pointing into a direction different from the pointing direction of the other groups of feeding lines 3. For example, in FIG. 9*a* each group 6 of patches consists of 4 patches 2, whereby the whole array antenna consists of four groups 6 of patches 2 having angles between the pointing directions of the groups of feeding lines 3 of 90 degrees.

It is further possible to arrange the patches 2 or the groups 6 of patches 2 in a way that the decoupling for two polarisation states, that is left hand and right hand, is best. This can be achieved by rotating the pointing directions of the groups of feeding lines 3 either clockwise as shown in FIGS. 9*a* and 9*c* or counter-clockwise as shown in FIGS. 9*b* and 9*d*.

It is to be noted that the present invention is not limited to patches arranged in a two-dimensional array but may also include a three-dimensional array of patches 2, where the pointing direction of feeding lines 3 put on top of each other are changed.

It is to be noted, that the term "set" according to the present invention refers to a combination of one or more patches 2 having only one feeding line 3. In case the set 10 comprises more than one patch 2, then the patches 2 of the set 10 are connected by connecting elements 9. The term "group" according to the present invention refers to a combination of one or more sets 10 of patches 2.

If for example the set 10 comprises only one patch 2 and the group 6 comprises only one set 10, then in this case the group 6 consists of only one patch. This means, that a group 6 can consist of one patch 2 or more patches 2, whereby each patch 2 has an associated feeding line 3 or that a group 6 can consist of one or more sets 10 of more than one patch 2, whereby each set 10 has an associated feeding line 3.

In the present invention according to FIG. 10, horns having different beam directions are therefore integrated in the antenna array. Hereby, the central axis of the horn is tilt depending on the position of the horn 4. FIG. 11 shows a cross section along the line A to A' in FIG. 10. It can be seen that in the example as shown in FIGS. 4 and 5 at a time two horns 4 have the same beam direction 7*a*, 7*b* or 7*c*. Hereby the two horns 4 in the middle have a vertical beam direction 7*b* along the z-axis of a sphere coordinate system. The more the horns 4 are away from the two horns 4 in the middle the more the beam direction is tilted, that is the angle between the axis 8 of the lateral horns 4 and the axis 8 of the middle horns 4 is increased. Depending on the desired beaming direction the signal energy transferred to and/or from the horns 4 is switched between the horns 4 having different beaming directions by a switch integrated in the control circuit of the array antenna. This way, a wide coverage of the hemisphere can be achieved without sacrificing the suppression of unwanted noise or side-lobe signals.

It is to be noted, that a group of horn antennas 4 having the same beaming direction may consist of one or more horn antennas 4 arranged either in row, rectangular, circular or otherwise, in a two- or three-dimensional array.

Hereby, the area, that is the beam scanning range covered by the whole antenna array is equal to the beam width covered by a single group of horns (4) having the same beaming direction multiplied with the number of beaming directions realised by different groups of horns (4).

FIGS. 12 and 13 show horns 4 having different shapes which can improve the electrical performance of the antenna. Principally a horn antenna 4 serves as a waveguide and is able to radiate and/or receive the signal energy transferred to and/or from the waveguide at the open end of line. An open waveguide as shown in FIG. 13 having a rectangular or circular cross-section can be used as a simple antenna. Further, it is possible to use a waveguide widened at one end in order to improve the radiation characteristics, and waveguides with smooth edges to improve the side-lobe performance as shown in FIG. 12.

It is to be noted that the present invention is not limited to the shapes of horns shown in the figures but includes every waveguide having the horn functionality.

As the array antenna according to the present invention is of a simple construction and low height, it can be manufactured with low effort and costs and it can be implemented in consumer products of small and compact size, such as mobile devices or consumer products.

With the circular polarised millimeter-wave antenna small side-lope levels preferably less than 15 decibel, high gain, a narrow half power beam width, e.g. less than 20 degree, an optimal decoupling between right hand and left hand polarisation and an easy manufacturing can be achieved.

The invention claimed is:

1. A circular polarized array antenna comprising:

groups of at least one set of patches for radiating or receiving a circular polarised electromagnetic wave; and a network of feeding lines, each feeding line being coupled to and extending longitudinally or vertically to one of the sets of patches for transferring signal energy to or from the set, wherein each feeding line is pointing in a direction different from a pointing direction of other feeding lines in order to achieve a circular orientation of the network of feeding lines, two groups of adjacent feeding lines include a same angle between adjacent feeding lines, and the at least one set of patches includes three patches.

2. The array antenna according to claim 1, wherein an angle between the pointing directions of two adjacent feeding lines is equal to 360 degrees divided by a number of feeding lines.

3. The array antenna according to claim 1, wherein a phase between two adjacent feeding lines is equal to 360 degrees divided by a number of groups of feeding lines.

4. The array antenna according to claim 1, wherein the array antenna includes at least four sets of patches arranged in an quadratic 2×2 array.

5. The array antenna according to claim 4, wherein the angle between the pointing directions of two adjacent feeding lines is equal to 90 degrees.

6. The array antenna according to claim 4, wherein a phase between two adjacent feeding lines is equal to 90 degrees.

7. The array antenna according to claim 1, wherein at least one of the feeding lines is coupled to a central patch of the set of three patches.

8. The array antenna according to claim 1, further comprising:

connection elements provided for connecting the three patches of the set of patches in order to enable transmission of signal energy between the patches.

9. The array antenna according to claim 8, wherein the connection elements are microstrip elements.

10. The array antenna according to claim 8, wherein the connection elements include discrete electric components.

11. The array antenna according to claim 1, further comprising:

a dielectric superstrate provided on top of the at least one set of patches.

12. The array antenna according to claim 8, wherein the dielectric superstrate is a quarter-wavelength superstrate.

13. The array antenna according to claim 1, wherein at least two sets of patches are integrated into one piece.

14. The array antenna according to claim 1, further comprising:

a horn antenna added to each set of patches in order to improve gain.

15. The array antenna according to claim 14, wherein at least a part of the horn is hollow.

16. The array antenna according to claim 14, further comprising:

a slot provided between two horn antennas for suppressing surface waves.

17. The array antenna according to claim 16, wherein the at least one set of patches includes at least one patch.

18. The array antenna according to claim 16, wherein an angle between the pointing directions of two adjacent feeding lines is equal to 360 degrees divided by a number of feeding lines.

19. The array antenna according to claim 16, wherein a phase between two adjacent feeding lines is equal to 360 degrees divided by a number of feeding lines.

20. The array antenna according to claim 16, wherein the array antenna includes at least four sets of patches arranged in an quadratic 2×2 array.

21. The array antenna according to claim 20, wherein the angle between the pointing directions of two adjacent feeding lines is equal to 90 degrees.

22. The array antenna according to claim 20, wherein a phase between two adjacent feeding lines is equal to 90 degrees.

23. The array antenna according to claim 16, wherein the at least one set of patches includes three patches.

24. The array antenna according to claim 23, wherein at least one of the feeding lines is coupled to the central patch of the set of three patches.

25. The array antenna according to claim 16, further comprising:

connection elements provided for connecting patches of the set of patches in order to enable transmission of signal energy between the patches.

26. The array antenna according to claim 25, wherein the connection elements are microstrip elements.

27. The array antenna according to claim 25, wherein the connection elements include discrete electric components.

28. The array antenna according to claim 16, further comprising:

a dielectric superstrate provided on top of the at least one set of patches.

29. The array antenna according to claim 16, wherein the dielectric superstrate is a quarter-wavelength superstrate.

30. The array antenna according to claim 16, wherein at least two sets of patches are integrated into one piece.

31. The array antenna according to claim 16, further comprising:

a horn antenna added to each set of patches in order to improve gain.

32. The array antenna according to claim 31, wherein at least a part of the horn is hollow.

33. The array antenna according to claim 16, wherein each patch of the at least one set of patches has an orientation different from other patches of said at least one set of patches.

34. A mobile terminal comprising a circular polarized array antenna according to claim 16.

35. The array antenna according to claim 1, wherein each patch of the at least one set of patches has an orientation different from other patches of said at least one set of patches.

36. A mobile terminal comprising a circular polarized array antenna according to any one of claims 1–16, and 35.

37. A method of making an array antenna that radiates or receives a circular polarized electromagnetic wave by groups of at least one set of patches, the method comprising the steps of providing a network of feeding lines, each feeding line being coupled to and extending longitudinally or vertically to one of the sets of patches for transferring signal energy to or from the set, arranged each feeding line so as to be coupled to a group of sets in such a way that each feeding line has a pointing direction different from a pointing direction of other feeding lines in order to achieve a circular orientation of the network of feeding lines, arranging two groups of adjacent feeding lines in such a way that the two adjacent groups of feeding lines include a same angle between adjacent feeding lines, and providing three patches for each set of patches.

38. The method according to claim 37, further comprising:

providing an angle between the pointing directions of two adjacent feeding lines that is 360 degrees divided by a number of feeding lines.

39. The method according to claim 37, further comprising:

providing a phase between two adjacent feeding lines that is 360 degrees divided by a number of feeding lines.

40. The method according to claim 37, further comprising:

providing at least four sets of patches arranged in an quadratic 2×2 array.

41. The method according to claim 37, further comprising:

providing an angle of 90 degrees between the pointing directions of two adjacent feeding lines.

42. The method according to claim 41, further comprising:

providing a phase of 90 degrees between two adjacent feeding lines.

43. The method according to claim 37, further comprising:

coupling one of the feeding lines to a central patch of the set of three patches.

44. The method according to claim 37, further comprising:

providing connection elements for connecting the three patches of the set of patches in order to enable transmission of signal energy between the patches.

45. The method according to claim 44, wherein the connection elements are microstrip elements.

46. The method according to claim 45, wherein the connection elements include discrete electric components.

47. The method according to claim 37, further comprising:

providing a dielectric superstrate on top of at least one patch.

48. The method according to claim 47, wherein the dielectric superstrate is a quarter-wavelength superstrate.

49. The method according to claim 37, further comprising:

integrating at least two sets of patches into one piece.

50. The method according to claim 37, further comprising:

adding a horn antenna to each set of patches in order to improve gain.

51. The method according to claim 50, further comprising:

providing a slot between two horn antennas for suppressing surface waves.

52. The method according to claim 51, wherein at least a part of the horn is hollow.

53. The method according to claim 51, further comprising:

providing at least one patch for a set.

54. The method according to claim 53, further comprising:

providing an angle between the pointing directions of two adjacent feeding lines that is 360 degrees divided by a number of feeding lines.

55. The method according to claim 53, further comprising:

providing a phase between two adjacent feeding lines that is 360 degrees divided by a number of feeding lines.

56. The method according to claim 53, further comprising:

providing at least four sets of patches arranged in an quadratic 2×2 array.

57. The method according to claim 56, further comprising:

providing an angle of 90 degrees between the pointing directions of two adjacent feeding lines.

58. The method according to claim 57, further comprising:

providing a phase of 90 degrees between two adjacent feeding lines.

59. The method according to claim 53, further comprising:

providing three patches for each set of patches.

60. The method according to claim 59, further comprising:

coupling one of the feeding lines to a central patch of the set of three patches.

61. The method according to claim 53, further comprising:

providing connection elements for connecting the patches of the set of patches in order to enable transmission of signal energy between the patches.

62. The method according to claim 61, wherein the connection elements are microstrip elements.

63. The method according to claim 61, wherein the connection elements include discrete electric components.

64. The method accroding to claim 53, further comprising:

providing a dielectric superstrate on top of at least one patch in the at least one set of patches.

65. The method according to claim 64, wherein the dielectric superstrate is a quarter-wavelength superstrate.

66. The method according to claim 53, further comprising:

integrating at least two sets of patches into one piece.

67. The method according to claim 53, further comprising:

adding a horn antenna to each set of patches in order to improve gain.

68. The method according to claim 67, wherein at least a part of the horn is hollow.

69. A beam-switching array antenna comprising:

sets of at least one patch for radiating or receiving a circular polarised electromagnetic wave; and horn antennas added to the sets in order to keep the same circular polarisation and increase gain, wherein the horn antennas are arranged such that each horn antenna has a beaming direction different from a beaming direction of other horn antennas, an axis of a central horn antenna is vertical and an axis of other horn antennas is tilted with respect to the axis of the central horn antenna, and a greater amount that the other horn antennas are offset from the central horn antenna, a greater amount the axis of the other horn antennas is tilted with respect to the axis of the central horn antenna.

70. The method of making a beam-switching array antenna that radiates or receives a circular polarized electromagnetic wave by sets of at least one patch, the method comprising the steps of:

providing horn antennas to each one of the sets in order to keep the same circular polarisation and increase gain, and arranging the horn antennas in such a way that each horn antenna has a beaming direction different from a beaming direction of the other groups of horn antennas, wherein an axis of a central horn antenna is vertical and an axis of other horn antennas is tilted with respect to the axis of the central horn antenna, and a greater amount that the other horn antennas are offset from the central horn antenna, a greater amount the axis of the other horn antennas is tilted with respect to the axis of the central horn antenna.

* * * * *